United States Patent [19]

Meyer et al.

[11] Patent Number: 4,620,708

[45] Date of Patent: Nov. 4, 1986

[54] GOLD PUTT TRAINING APPARATUS

[76] Inventors: Charles D. Meyer, 6714 Baker La., Sebastopol, Calif. 95472; Bruce A. Bennett, 15 Chestnut Ave., San Rafael, Calif. 94901

[21] Appl. No.: 715,112

[22] Filed: Mar. 22, 1985

[51] Int. Cl.[4] ..... A63B 69/36

[52] U.S. Cl. ..... 273/192; 273/176 A; 273/176 FB

[58] Field of Search ..... 273/191 R, 192, DIG. 21, 273/176 FB, 186 R, 186 C, 176 A, 176 AA, 176 AB

[56] References Cited

U.S. PATENT DOCUMENTS

| | | | |
|---|---|---|---|
| 1,545,648 | 7/1925 | Fletcher | 273/192 |
| 2,869,875 | 1/1959 | Steenson | 273/DIG. 21 |
| 3,332,688 | 7/1967 | Gevertz | 273/186 C |
| 3,471,155 | 10/1969 | Donaldson | 273/186 R |
| 3,572,720 | 3/1971 | Berg | 273/186 R |
| 3,604,711 | 9/1971 | Hansburg | 273/DIG. 21 |
| 3,885,796 | 5/1975 | King | 273/186 C |
| 3,899,180 | 8/1975 | Rodman | 273/186 C |
| 4,230,319 | 10/1980 | Lindner | 273/176 FB X |
| 4,423,875 | 1/1984 | Miller | 273/192 X |

*Primary Examiner*—George J. Marlo

*Attorney, Agent, or Firm*—Flehr, Hohbach, Test, Albritton & Herbert

[57] ABSTRACT

Portable apparatus for training a golfer to putt a ball correctly. The apparatus has guide rails and extensible flexible cords which guide the golfer in swinging the putter along a straight line and hitting the ball along a desired path.

The rails are secured to the ground by pins which project from the lower surfaces of the rails. When the device is not in use, the flexible cords are wrapped about the pins, and the rails are brought together with the pins of one rail being received in sockets in the other. The device can be broken down or collapsed into a relatively small package which is easily carried in a golf bag.

10 Claims, 3 Drawing Figures

FIG_1
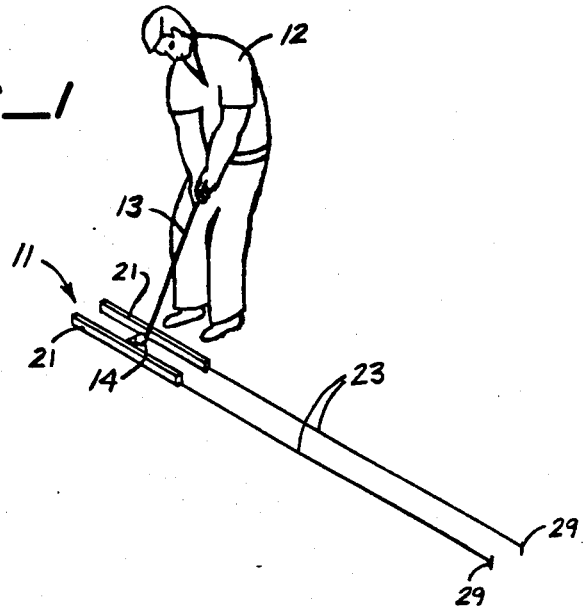
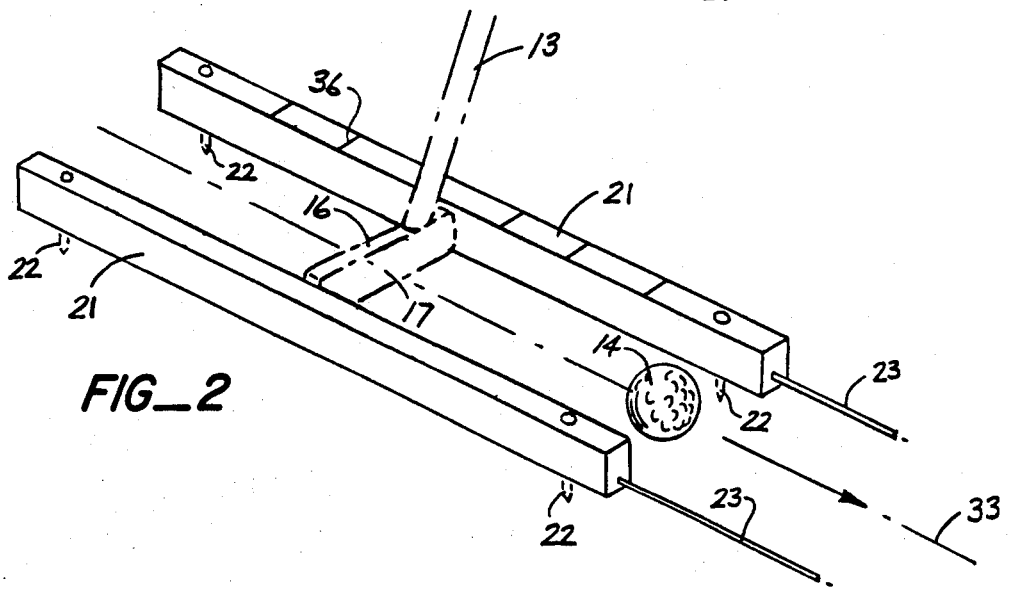
FIG_2
FIG_3
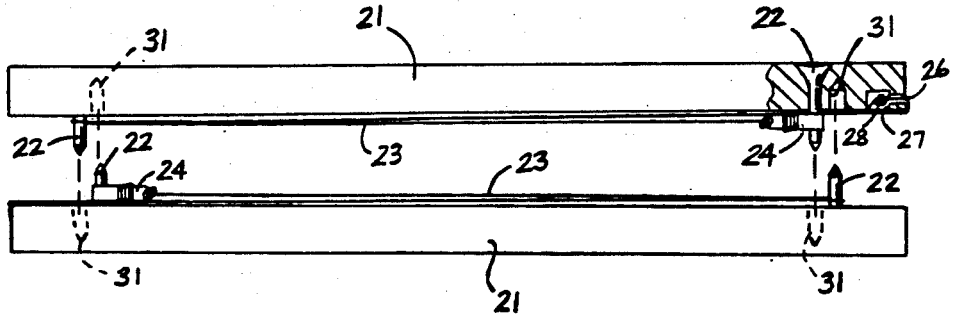

GOLD PUTT TRAINING APPARATUS

This invention pertains generally to golfing equipment, and more particularly to highly portable apparatus for training a golfer to putt a ball correctly.

Heretofore, a number of devices have been provide for helping a golfer to improve his putting game. Examples of such devices are found in U.S. Pat. Nos. 1,545,648, 3,332,688, 3,471,155, 3,572,720, 3,885,796 and 3,899,180. These devices are intended to improve different aspects of the putting stroke such as the angle of the club face relative to the ball, the direction of the swing and the length of the backswing and follow-through. The devices heretofore provided have certain limitations and disadvantages in that they are somewhat cumbersome and difficult to carry, and at least some of them cannot be used on a real putting green.

It is in general an object of the invention to provide a new and improved apparatus for training a golfer to putt a ball correctly.

Another object of the invention is to provide apparatus of the above character which is collapsible and highly portable.

Another object of the invention is to provide apparatus of the above character which can be utilized on a conventional putting green.

These and other objects are achieved in accordance with the invention by providing putt training apparatus having a pair of elongated guide rails which are secured to the ground in spaced parallel relation by pins which project from the lower surfaces thereof. Elongated flexible cords extend axially from the ends of the guide rails and define a target path for the ball. Index marks on one of the rails enable the golfer to gauge the length of his backswing and/or follow-through, and the height of the rails is such that the head of the club must travel along a straight line between the rails to strike the ball. The device collapses to a compact package which is easily carried in a golf bag when not in use.

FIG. 1 is a prospective view of a golfer using one embodiment of putt training apparatus according to the invention.

FIG. 2 is a fragmentary isometric view of the putt training apparatus of FIG. 1 in its operational position.

FIG. 3 is an exploded side elevational view, partly broken away, of the putt training apparatus in its collapsed state.

In the drawings, the training apparatus 11 is illustrated in conjunction with a golfer 12, a putting club or putter 13 and a ball 14. The putter is of conventional design and includes a club head 16 with a face 17 for striking the ball.

The training apparatus includes a pair of elongated guide rails 21 of generally rectangular cross-section. Ground engaging pins 22 project from the lower sides of the rails near the front and rear ends of the rails.

Elongated flexible cords 23 extend in an axial direction from the front ends of the rails. The inner ends of the cords are affixed to the rails, and the outer ends have hooks 24 attached thereto. In the embodiment illustrated, bores 26 of relatively small diameter extend through the front walls of the rails, and intersecting bores 27 of larger diameter open through the lower surfaces of the rails. The inner ends of the flexible cords extend through bores 26 and are knotted behind these bores, as indicated at 28, to secure the cords to the rails. The outer ends of the cords are secured to the ground by pins 29 which pass through hooks 24. The cords are preferably fabricated of an elastic material.

Sockets 31 are formed in the guide rails and open through the lower surfaces thereof to receive the pins 22 of the opposite rail when the apparatus is in its collapsed state. Pins 22 are inset different distances from the front and rear ends of the guide rails, and sockets 31 are inset in a reciprocal manner. Thus, when the pins are inserted in the sockets the front end of one guide rail is aligned directly with the rear end of the other. The pins fit snugly in the sockets and thus tend to hold the rails together in the collapsed position, while permitting the rails to be separated without undue force.

Indexing marks 36 are provided at equally spaced intervals along the upper surface of one of the guide rails. These marks provide a reference by which the golfer can gauge the backswing and/or follow-through of his stroke.

In the operational position, rails 21 are secured to the ground in a spaced parallel relation on opposite sides of an imaginary target line 33. The rails are separated by a distance slightly greater than the width of putter head 16, and they have a height approximately equal to the diameter of golf ball 14. In order to strike the ball, the golfer must swing the club so that the head travels along a straight line between the guide rails. Cords 23 are extended in an axial direction from the front ends of the guide rails and secured to the ground on opposite sides of the imaginary target line to define an invisible target path for the ball. The golfer can gauge the length of his backswing and/or follow-through by observing the position of the club head relative to indexing marks 36.

When the apparatus is broken down or collapsed for carrying or storage, cords 23 are wrapped about pins 22, and the free ends of the cords are secured to these pins. As illustrated in FIG. 3, each of the cords is trained about the pin at the rear of the guide rail, and hook 24 is engaged with the pin at the front end of the rail with the cord in a stretched condition. The two guide rails are then placed in a juxtaposed position, with the lower faces of the two rails facing each other and the pins 22 of one rail being received in the sockets 31 of the other. In the collapsed state, the apparatus is of a relatively small size which can be carried in one of the pockets of a conventional golfing bag.

It is apparent from the foregoing that a new and improved putt training apparatus has been provided. While only one presently preferred embodiment has been described in detail, as will be apparent to those familiar with the art, certain changes and modifications can be made without departing from the scope of the invention as defined by the following claims.

We claim:

1. Collapsible apparatus for training a golfer to putt a ball along a target line, comprising a pair of elongated guide rails having ground engaging pins projecting from first sides thereof and pin receiving sockets in said first sides, said guide rails being movable between a collapsed position in which the rails are juxtaposed with the first sides facing each other and the pins interfitting with the sockets of the opposite rails to hold the rails together and an operating position in which the guide rails are positioned in spaced parallel relation on opposite sides of the target line with the first sides facing in a downward direction and the pins extending into the ground to secure the rails in position, and an axially extensible guide member extending from one end of each of the guide rails for movement between a retracted position relative to the guide rails when the guide rails are in their collapsed position and an extended position when the guide rails are in the operating position.

2. The apparatus of claim 1 wherein the extensible guide member comprises an elongated flexible cord which is adapted to be wrapped about the pins in its retracted position and to extend along a line parallel to the target line in its extended position.

3. The apparatus of claim 2 wherein the cord is elastic, one end of the cord being connected to one end of the guide rail and the other end of the cord being adapted to be anchored to the ground to hold the cord in a stretched condition when the cord is in its extended position.

4. The apparatus of claim 1 including indexing marks on the side of one of the rails opposite the one side, said marks facing in an upward direction and being visible to the golfer when the rails are in the operating position.

5. The apparatus of claim 1 wherein the pins and sockets are provided in such manner that the ends of the rails are aligned directly with each other when the rails are in the collapsed position.

6. Apparatus for training a golfer to putt a ball along a target line, comprising a pair of elongated rails positioned in spaced parallel relation on opposite sides of the target line and being separated by a distance somewhat greater than the width of the head of a putting club, said rails having a height corresponding to the diameter of the ball so that the golfer must swing the head of the putting club along a straight line between the rails in order to strike the ball when it is positioned between the rails, ground engaging pins extending downwardly from the lower sides of the guide rails and anchoring the rails to the ground, and an elongated flexible cord extending axially from each of the guide rails and anchored to the ground on opposite sides of the target line to define a target path for the ball.

7. The apparatus of claim 6 including sockets formed on the lower sides of the guide rails for receiving the ground engaging pins of the opposite rails when the rails are removed from the ground and positioned together in a closed position with the lower sides of the rails facing each other.

8. The apparatus of claim 7 wherein the flexible cords are adapted to be wrapped about the pins between the rails when the rails are in the closed position.

9. The apparatus of claim 6 wherein the cord extending from each of the rails comprises an elastic cord which is adapted to be affixed to the ground in a stretched condition.

10. The apparatus of claim 6 wherein one of the guide rails has axially spaced indexing marks on the upper side thereof for gauging the length of the putting stroke.

* * * * *